US007786792B1

(12) United States Patent
Gay

(10) Patent No.: US 7,786,792 B1
(45) Date of Patent: Aug. 31, 2010

(54) CIRCUITS, ARCHITECTURES, APPARATUSES, SYSTEMS, AND METHODS FOR LOW NOISE REFERENCE VOLTAGE GENERATORS WITH OFFSET COMPENSATION

(75) Inventor: Michael J. Gay, Coppet Vaud (CH)

(73) Assignee: Marvell International Ltd., Hamilton (BM)

( * ) Notice: Subject to any disclaimer, the term of this patent is extended or adjusted under 35 U.S.C. 154(b) by 72 days.

(21) Appl. No.: 12/248,529

(22) Filed: Oct. 9, 2008

Related U.S. Application Data

(60) Provisional application No. 61/013,161, filed on Dec. 12, 2007, provisional application No. 60/978,930, filed on Oct. 10, 2007.

(51) Int. Cl.
*G05F 1/10* (2006.01)

(52) U.S. Cl. ..... 327/539; 327/513

(58) Field of Classification Search ..... 327/512, 327/513, 539
See application file for complete search history.

(56) References Cited

U.S. PATENT DOCUMENTS

| | | | | |
|---|---|---|---|---|
| 4,375,595 | A | 3/1983 | Ulmer et al. | |
| 5,059,820 | A * | 10/1991 | Westwick | 327/539 |
| 5,352,972 | A * | 10/1994 | Pernici et al. | 323/313 |
| 5,563,504 | A | 10/1996 | Gilbert et al. | |
| 5,982,221 | A * | 11/1999 | Tuthill | 327/512 |
| 6,019,508 | A * | 2/2000 | Lien | 374/178 |
| 6,060,874 | A * | 5/2000 | Doorenbos | 323/316 |
| 6,097,239 | A * | 8/2000 | Miranda et al. | 327/512 |
| 6,215,353 | B1 * | 4/2001 | Lewyn | 327/538 |
| 6,819,163 | B1 * | 11/2004 | Gregoire, Jr. | 327/536 |
| 6,962,436 | B1 * | 11/2005 | Holloway et al. | 374/170 |
| 7,236,047 | B2 * | 6/2007 | Tachibana et al. | 327/539 |
| 7,281,846 | B2 * | 10/2007 | McLeod | 374/178 |
| 7,429,129 | B2 * | 9/2008 | St. Pierre et al. | 374/178 |
| 2007/0013436 | A1 * | 1/2007 | Chou | 327/539 |

OTHER PUBLICATIONS

Mike Tuthill; "Brief Papers: A Switched-Current, Switched-Capacitor Temperature Sensor in 0.6-um CMOS"; IEEE Journal of Solid-State Circuits; Jul. 1998; pp. 1117-1122; vol. 33, No. 7; IEEE; Item No. S 0018-9200(98)03434-9.

Suheng Chen and Benjamin J. Blalock; "Switched Capacitor Bandgap Voltage Reference for Sub-1-V Operation"; IEICE Electronics Express; pp. 529-533; vol. 3, No. 24.

* cited by examiner

*Primary Examiner*—Lincoln Donovan
*Assistant Examiner*—Thomas J Hiltunen

(57) ABSTRACT

Circuits, architectures, systems, and methods for generating temperature-stable reference voltages with offset compensation. The circuits generally include a diode junction voltage generator, and three composite voltage generators configured to operate in first and second phases or modes of operation. The diode junction voltage generator produces first and diode junction voltages with different current densities (Vd1 and Vd2). The first composite voltage (VC1) comprises at least a fraction of the first and/or second diode junction voltage. The second composite voltage (VC2) is generated during the first phase and comprises a difference between Vd2 and a sum of VC1 and an offset voltage (Ve) of an amplifier and/or other summation circuit. The third composite voltage (VC3) is generated during the second phase such that VC3 is proportional to a difference between Vd1 and a sum of Ve and VC2. A temperature-stable reference voltage proportional to VC3 may be continuously generated. Embodiments advantageously produce reference voltages much smaller than the band-gap voltage, are substantially insensitive to any voltage offset in the associated summation circuit, and/or produce low noise without further filtering.

25 Claims, 8 Drawing Sheets

CIRCUITS, ARCHITECTURES, APPARATUSES, SYSTEMS, AND METHODS FOR LOW NOISE REFERENCE VOLTAGE GENERATORS WITH OFFSET COMPENSATION

RELATED APPLICATIONS

This application claims the benefit of U.S. Provisional Application No. 60/978,930, filed Oct. 10, 2007, and U.S. Provisional Application No. 61/013,161, filed Dec. 12, 2007, the contents of which are incorporated herein by reference in their entireties.

FIELD OF THE INVENTION

The present invention generally relates to the field of reference voltage generators. More specifically, embodiments of the present invention pertain to circuits, architectures, systems, and methods for low noise reference voltage generators with low noise and offset compensation.

BACKGROUND

Voltage references are required in many types of electronic equipment. As is well-known they are commonly designed to produce outputs proportional to the semiconductor band-gap voltage (e.g., the silicon band-gap voltage at approximately 1.26V), which is inherently well-defined and insensitive to temperature.

In practice the band-gap voltage is obtained by the summation of two components, a first proportional to the difference in the bias voltages of a pair of junction diodes operating at different current densities, commonly referred to as the PTAT (proportional to absolute temperature) component and a second proportional to the full junction voltage of one of the diodes, or a similar diode, commonly referred to as the CTAT (complementary to absolute temperature) component.

A significant problem is that the PTAT component, attaining 18 mV for each factor of two in the current density ratio, cannot, practicably, be made large. Voltage offsets in the summation circuits can therefore introduce relatively large errors. Likewise, the reference output may be sensibly degraded by low frequency noise components introduced by the summation circuits.

Another problem is that the silicon band-gap voltage of 1.26V is higher than the maximum operating voltage permitted for the most recent CMOS circuits. Some well-defined fraction of this must therefore be generated. The deleterious effects of offset voltages and low frequency noise are commonly mitigated by using large area active and passive elements in the processing circuits. A disadvantage of this approach is that the offsets and noise remain only statistically predictable and are subject to variations and changes in the manufacturing process. A second disadvantage is that the physical area required may become prohibitively large. Further disadvantages are that large devices are more susceptible to leakage current, which is another noise and error source, and are more susceptible to perturbing signals.

In another approach, switched capacitor reference generators employing offset compensation, which aim to sensibly reduce errors and low frequency noise without recourse to large area devices, have been developed. However, while conventional switched capacitor reference voltage generators may show significant reduction of the error produced by an offset voltage of the summation circuit, they generally do not fully eliminate it.

Furthermore, in some conventional switched capacitor reference generators the residual error becomes increasingly significant as the reference voltage is reduced. Other conventional switched capacitor reference generators may be adapted to produce reference voltages below the band-gap level, while maintaining relatively low sensitivity to the offset voltage. The conventional generators, however may use voltage subtraction means to reduce the CTAT component, making the output increasingly sensitive to capacitor matching errors as the reference voltage is reduced.

A further disadvantage of conventional switched capacitor reference generators is that the output may be discontinuous, alternating between a "pre-charge" state and a "valid" state, such that further sampling may be needed to provide a continuous voltage. Another, related, disadvantage is that, as the amplifier must charge feedback capacitor means to pass from the pre-charge to valid states, the bandwidth must be large compared with the clock frequency, producing high noise levels.

It may therefore be advantageous to provide a reference voltage generator adapted to produce continuous outputs much smaller than the band-gap voltage, which is fully insensitive to any voltage offset in the associated summation circuit, which produces a small CTAT component without recourse to voltage subtraction means and which generates low noise without further filtering.

SUMMARY

Embodiments of the present disclosure relate to circuitry, architectures, systems, and methods for generating one or more reference voltages. In particular, the embodiments provide reference voltages with continuous outputs much smaller than the band-gap voltage, which are substantially insensitive to any voltage offset in the associated summation circuit, which produce a small complementary to absolute temperature (CTAT) component without recourse to voltage subtraction means, and/or which generate low noise without further filtering.

The circuitry generally comprises a diode junction voltage generator, and three composite voltage generators configured to operate in first and second modes of operation (e.g., during opposite phases of a reference clock signal). The diode junction voltage generator is generally configured to generate a first diode junction voltage (Vd1) in response to a first bias current, and a second diode junction voltage (Vd2) in response to a second bias current. The current density of the first bias current is generally higher than the current density of the second bias current (e.g., so that Vd1 is significantly larger than Vd2).

The first composite voltage generator is generally configured to generate a first composite voltage (VC1) comprising at least a fraction of the first and/or second diode junction voltage. For example, the first composite voltage may include part or all of a proportional to absolute temperature (PTAT) component and/or a complementary to absolute temperature (CTAT) component.

During the first mode, the second composite voltage generator is generally configured to generate a second composite voltage (VC2) such that the second composite voltage comprises a difference between Vd2 and a sum of the VC1 and an offset voltage (Ve) of an amplifier and/or other summation circuit. During the second mode, the second composite voltage generator is generally configured to maintain VC2 at a generally constant level (e.g., so that VC2 does not drift during the second mode).

During the second mode, the third composite voltage generator is generally configured to generate a third composite voltage (VC3) during the second mode of operation such that VC3 is proportional to a difference between Vd1 and a sum of Ve and VC2. During the first mode, the third composite voltage generator is generally configured to maintain VC3 at a generally constant level.

Embodiments may further comprise a plurality of switches configured to alternate repeatedly between the first and second modes of operation (e.g., to control the operation of one or more of the components in response to a current mode of operation). Embodiments may also comprise a voltage buffer configured to continuously generate the reference voltage in proportion to VC3.

In exemplary embodiments, the diode junction voltage generator may be configured such that the difference between Vd1 and Vd2 components is substantially resistant to process variations between the current sources used to bias one or more diodes. In some embodiments a pair of diodes are biased a different current densities to generate the PTAT and CTAT components. The diodes may have different diode areas, and may be biased by nominally equal current sources which are switched between the diodes depending on the current mode of operation.

In other embodiments, a single diode may be alternately biased at lower and higher currents to provide the two components. For example, these currents may be provided by a plurality of equal sources during one mode of operation, and by a single one of the current sources during another mode. In order to reduce the effect of process variations between the current sources, the single current source may be selected sequentially during each iteration.

The architectures, apparatuses, and/or systems generally comprise those that include a circuit embodying one or more of the inventive concepts disclosed herein. Embodiments of the present invention may include one or more integrated circuit devices (e.g., general purpose microprocessors, system-on-chip [SOC] devices, application specific integrated circuits [ASICs], etc.) or other apparatuses that include the circuits and/or perform the operations described herein.

Embodiments of present invention may advantageously continuously produce temperature-stable reference voltages much smaller than the band-gap voltage, are substantially insensitive to any voltage offset in the associated summation circuit, and/or produce low noise without further filtering.

These and other advantages of the present invention will become readily apparent from the detailed description of embodiments below.

DETAILED DESCRIPTION

Figure 1A:
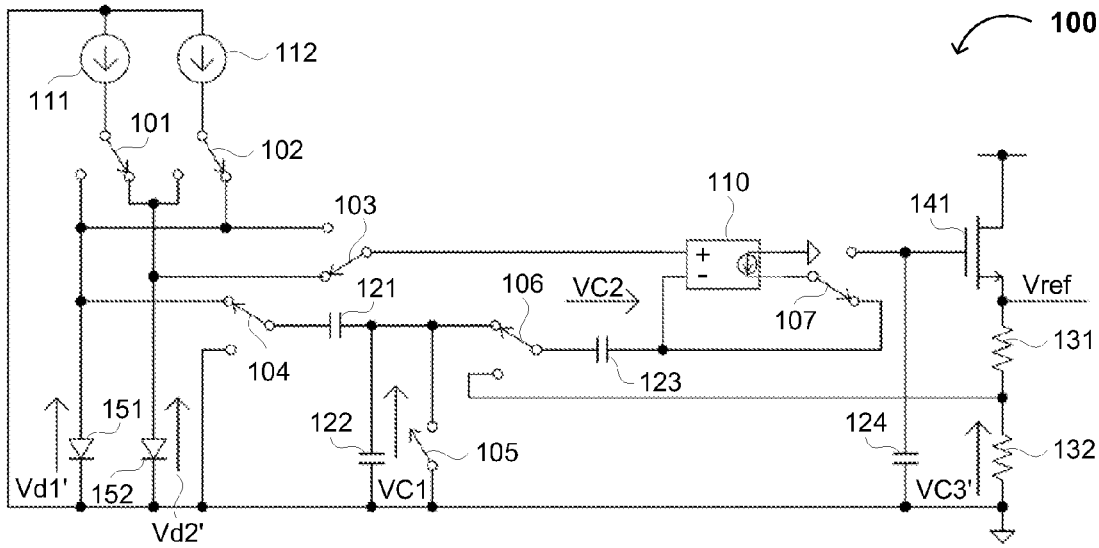
FIGS. 1A and 1B are diagrams of an exemplary embodiment of a circuit for generating a reference voltage, in two different modes of operation.

Reference will now be made in detail to embodiments of the invention, examples of which are illustrated in the accompanying drawings. While the invention will be described in conjunction with the embodiments, it will be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the embodiments of the present invention, numerous specific details are set forth in order to provide a thorough understanding of the embodiments of the present invention. However, it will be readily apparent to one skilled in the art that the embodiments of the present invention may be practiced without these specific details. In other instances, well-known methods, procedures, components, and circuits have not been described in detail so as not to unnecessarily obscure aspects of the embodiments of the present invention.

Some portions of the detailed descriptions which follow are presented in terms of processes, procedures, logic blocks, functional blocks, processing, and other symbolic representations of operations on data bits, data streams or waveforms within a computer, processor, controller and/or memory. These descriptions and representations are generally used by those skilled in the data processing arts to effectively convey the substance of their work to others skilled in the art. A process, procedure, logic block, function, operation, etc., is herein, and is generally, considered to be a self-consistent sequence of steps or instructions leading to a desired and/or expected result. The steps generally include physical manipulations of physical quantities. Usually, though not necessarily, these quantities take the form of electrical, magnetic, optical, or quantum signals capable of being stored, transferred, combined, compared, and otherwise manipulated in a computer, data processing system, or logic circuit. It has proven convenient at times, principally for reasons of common usage, to refer to these signals as bits, waves, waveforms, streams, values, elements, symbols, characters, terms, numbers, or the like.

Furthermore, for the sake of convenience and simplicity, the terms "clock," "time," "rate," "period" and "frequency" are generally used interchangeably herein, but are generally given their art-recognized meanings. Also, for convenience and simplicity, the terms "connected to," "coupled with," "coupled to," and "in communication with" (which terms also refer to direct and/or indirect relationships between the connected, coupled and/or communication elements unless the context of the term's use unambiguously indicates otherwise) may be used interchangeably, but these terms are also generally given their art-recognized meanings Finally, for the sake of convenience the terms "mode of operation," "state," and "clock phase" may be used interchangeable herein to refer to alternating circuit configurations (e.g., which may be implemented with switches configured to respond to one or more phases of a reference clock).

The invention, in its various aspects, will be explained in greater detail below with regard to exemplary embodiments.

A First Exemplary Circuit

Figure 1B:
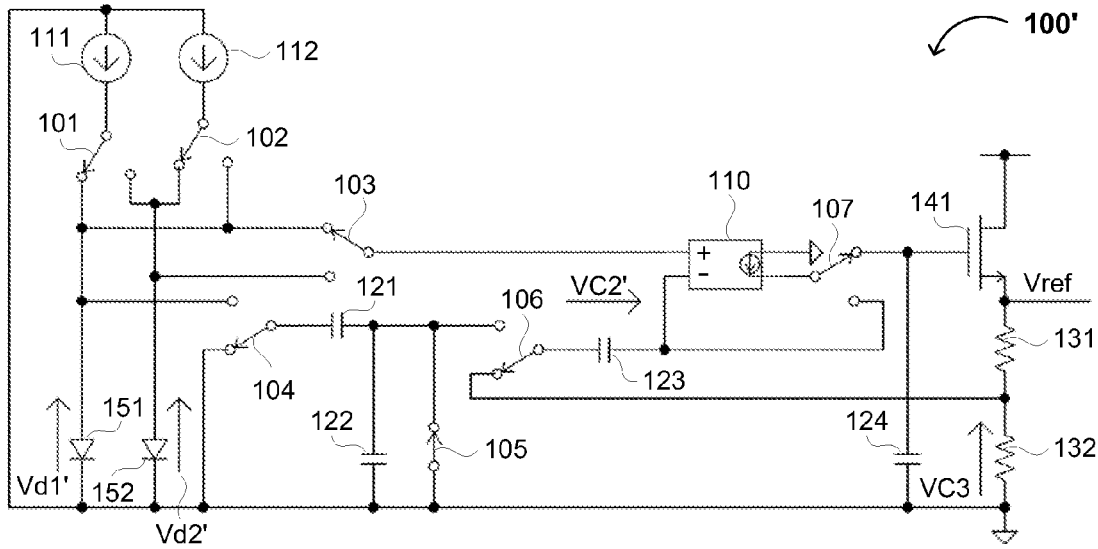
Figure 7:
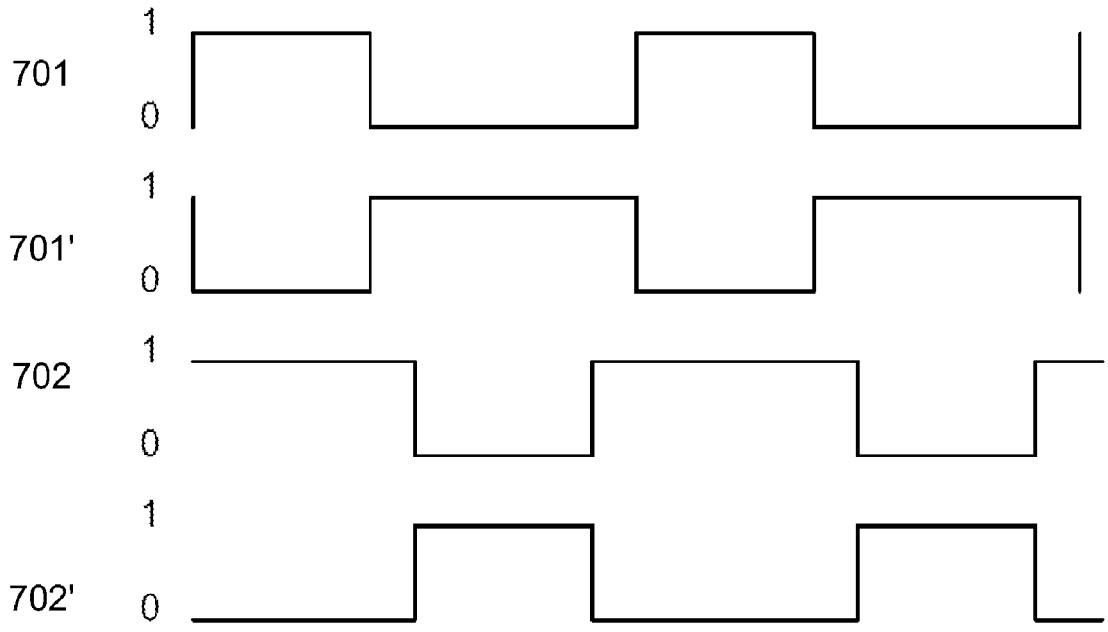
FIG. 7 is a diagram of exemplary reference clocks as may be used by the present embodiments.

FIG. 1A shows a simplified exemplary circuit 100 in a first state or mode of operation. FIG. 1B shows the same circuit 100' in a second state or mode of operation. The Circuit 100 differs from circuit 100' in the setting of switches 101-107. Switches 101-107 may, for example, comprise transistor switches (e.g., exemplary transistor switch 800 of FIG. 8) controlled by a pair of suitable clock signals (e.g., clock signals 701/701' or 702/702' of FIG. 7).

The circuit includes a diode junction voltage generator for generating diode junction voltages for two different current densities. In circuit 100, the diode junction voltage generator includes diodes 151 and 152. Diode 152 has a larger area than diode 151. The first terminal of diode 151 is coupled to the second terminal of a changeover switch 101 and to the first terminal of changeover switch 102. The first terminal of diode 152 is coupled to the first terminal of the changeover switch 101 and to the second terminal of the changeover switch 102. The common terminals of changeover switches 101 and 102 are coupled respectively to first terminals of current sources 111 and 112. The exemplary current sources 111 and 112 have second terminals connected to the common ground, and are generally configured to forward bias the diodes 151 and/or 152. The diode junction voltage generator is generally configured to generate a first diode junction voltage (Vd1) in response to a first bias current density, and a second diode junction voltage (Vd2) in response to a second bias current density. The first bias current density is generally higher than the second bias current density (e.g., so that Vd1 is significantly larger than Vd2).

The first terminal of diode 151 is also connected to the second terminal of a changeover switch 103. The first terminal of diode 152 is also connected to the first terminal of switch 103, and the common terminal of switch 103 is connected to the non-inverting input of a transconductor 110. Transconductor 110 is generally configured to produce an output current proportional to a difference between a non-inverting input (+) and an inverting input (−). The first terminal of diode 151 is further connected to the first terminal of a changeover switch 104, having a second terminal connected to the common ground.

A first composite voltage generator includes capacitors 121 and 122, and is generally configured to generate a first composite voltage (VC1) comprising at least a fraction of the first and/or second diode junction voltage.

The common terminal of switch 104 is connected to a first terminal of a capacitor 121 (C1), having a second terminal connected to the first terminal of a capacitor 122 (C2), to the first terminal of a changeover switch 106, and to a first terminal of a simple switch 105, which is generally configured to be open during the first state and closed during the second state. The second terminals of capacitor 122 and switch 105 are connected to the common ground.

A second composite voltage generator includes capacitor 123, and is generally configured to generate a second composite voltage (VC2) such that the second composite voltage comprises a difference between Vd2 and a sum of VC1 and an offset voltage (Ve) of amplifier/transconductor 110. During the second mode, the second composite voltage generator is generally configured to maintain VC2 at a generally constant level (e.g., so that VC2 does not drift during the second mode).

The common terminal of switch 106 is coupled via a capacitor 123 (C3) to the inverting input of the transconductor 110. The output of the transconductor is connected to the common terminal of a changeover switch 107. The first terminal of switch 107 is connected to the inverting input of the transconductor and the second terminal is connected to the first terminal of a capacitor 124 (C4), having a second terminal connected to the common ground, and is also connected to the gate electrode of a transistor (e.g., an NMOS transistor) 141. The drain of transistor 141 is connected to a positive power supply.

The source of transistor 141 is connected to the reference voltage (Vref) output terminal and to the input terminal of a resistive potential divider including resistors 131 (R1) and 132 (R2), having input, mid-point and common ground terminals. The mid-point terminal of the potential divider is connected to the second terminal of switch 106.

A third composite voltage generator includes capacitor 124, and is generally configured to generate a third composite voltage (VC3) during the second mode of operation such that VC3 is proportional to a difference between Vd1 and a sum of Ve and VC2. During the first mode, the third composite voltage generator is generally configured to maintain VC3 at a generally constant level.

In the second mode of operation (circuit 100') capacitors 121 (C1) and 122 (C2) are discharged. Subsequently, in the first mode of operation capacitor 121 is connected in series with the diode voltage Vd1 and capacitor 122 generating a composite voltage VC1, across 122 which is a fraction of Vd1. Capacitor 122 is coupled to the inverting input of the transconductor 110 via the switch 106 and capacitor 123 (C3). The non-inverting input of the transconductor may be coupled to diode 152 via switch 103 to receive voltage Vd2. The transconductor output is connected to its inverting input via switch 107, thereby forming a negative feedback loop which develops a voltage across capacitor 123 such that the transconductor 110 output current tends to zero. For the purposes of this description the transconductor 110 may be assumed to have an arbitrary input offset voltage of Ve, but to otherwise be ideal. Thus, under steady-state conditions, the voltages during the first mode of operation will be given by the equations:

$$VC2 = Vd2 - Ve - VC1 \qquad \text{(EQ. 1)}$$

$$VC2 = Vd1\frac{C1}{C1 + C2}$$

In the second mode of operation (circuit 100') the non-inverting input of the transconductor 110 is connected to the diode 151 and therefore receives the higher diode voltage Vd1. The transconductor 110 output is coupled to capacitor 124 which is coupled, via the transistor 141, to resistors 131 and 132, the mid-point of which is coupled to the transconductor 110 inverting input via switch 106 and capacitor 123. A second negative feedback loop is thereby established and this loop tends to develop a voltage across capacitor 124 such that the transconductor output current again tends to zero. The voltage VC2 across capacitor 123 that was developed in the first mode of operation is maintained as voltage VC2' during the second mode of operation, because there is no conductive path between its terminals. The voltage VC3 across resistor 132 is proportional to the charge across capacitor 124. As a result, steady-state voltages in the second mode of operation may be given by the equations:

$$VC2' = VC2 = Vd1 - Ve \quad \text{(EQ. 2)}$$

Combining EQ. 1 and EQ. 2 yields:

$$\begin{aligned} VC3 &= Vd1 - Ve - VC2' \\ &= Vd1 - Ve - VC2 \\ &= Vd1 - Ve - (Vd2 - Ve - VC1) \\ &= Vd1 - Vd2 + VC1 \\ &= Vd1 - Vd2 + Vd1\frac{C1}{C1 + C2} \end{aligned} \quad \text{(EQ. 3)}$$

Thus, composite voltage VC3 includes a sum of a proportional to absolute temperature (PTAT) component (e.g., Vd1−Vd2) and a complementary to absolute temperature (CTAT) component (e.g., Vd1(C1/C1+C2)). As a result, VC3 will generally be a temperature stable voltage when the ratio of the PTAT and CTAT components are selected according to the relationship:

$$\frac{CTAT}{PTAT} = \frac{Vd}{Vbg - Vd} \quad \text{(EQ. 4)}$$

where Vbg is the band-gap voltage and Vd is the bias voltage of the diode employed. Thus, capacitors 121 (C1) and 122 (C2) may be selected according to the following relationship:

$$C1 = \frac{C2(Vd1 - Vd2)}{Vbg - 2Vd1 + Vd2} \quad \text{(EQ. 5)}$$

Thus, the temperature stable voltage VC3stab may be determined according to the equation:

$$VC3stab = \frac{(Vd1 - Vd2)Vbg}{Vbg - Vd1} \quad \text{(EQ. 6)}$$

During the first mode of operation, composite voltage VC3 may be maintained as voltage VC3', because there is no conductive path in parallel with capacitor 124 in the first mode of operation. As a result, the output voltage Vref, is continuous and may be determined according to the equation:

$$Vref = \frac{R1 + R2}{R2} VC3' \quad \text{(EQ. 7)}$$

Because the charge VC2 of capacitor 123 (C3) and a charge of capacitor 124 (C4) (e.g., a charge proportional to VC3) are maintained from period to period, amplifier 110 does not require a high transconductance and. Furthermore, capacitor 124 may be relatively large in order to reduce thermal output noise of the reference voltage generator. In addition, low frequency noise produced by the transconductor 110 will tend to be suppressed, in the same manner as the offset voltage (e.g., where the frequency of the noise is low frequency meaning much lower than the frequency of iteration of the first and second modes or states).

In alternative embodiments, during the first mode of operation capacitor 121 may be coupled to diode 152 instead of to 151, or may be coupled to any similar and appropriately biased diode. One skilled in the art may be able to design other alternative switching arrangements to generate the diode junction voltages and/or to generate a fraction of one or both of the diode junction voltages.

Circuit 100 is configured such that the difference between Vd1 and Vd2 components is substantially resistant to process variations between the current sources used to bias one or more diodes. During the first mode of operation, diode 152, which is then connected to the non-inverting input of transconductor 110, is biased by current I1 from current source 111. During the second mode of operation, diode 151 is biased by the same current I1. As a result, the difference voltage Vd1−Vd2 is generally determined by diodes biased from the same current source. Therefore, current sources 111 and 112 are not required to be well matched. Furthermore, the difference voltage Vd1−Vd2 will be substantially insensitive to low frequency noise components of these currents (e.g., where the frequency of the noise is low frequency meaning much lower than the frequency of iteration of the first and second modes or states).

An Exemplary Method

Figure 2:
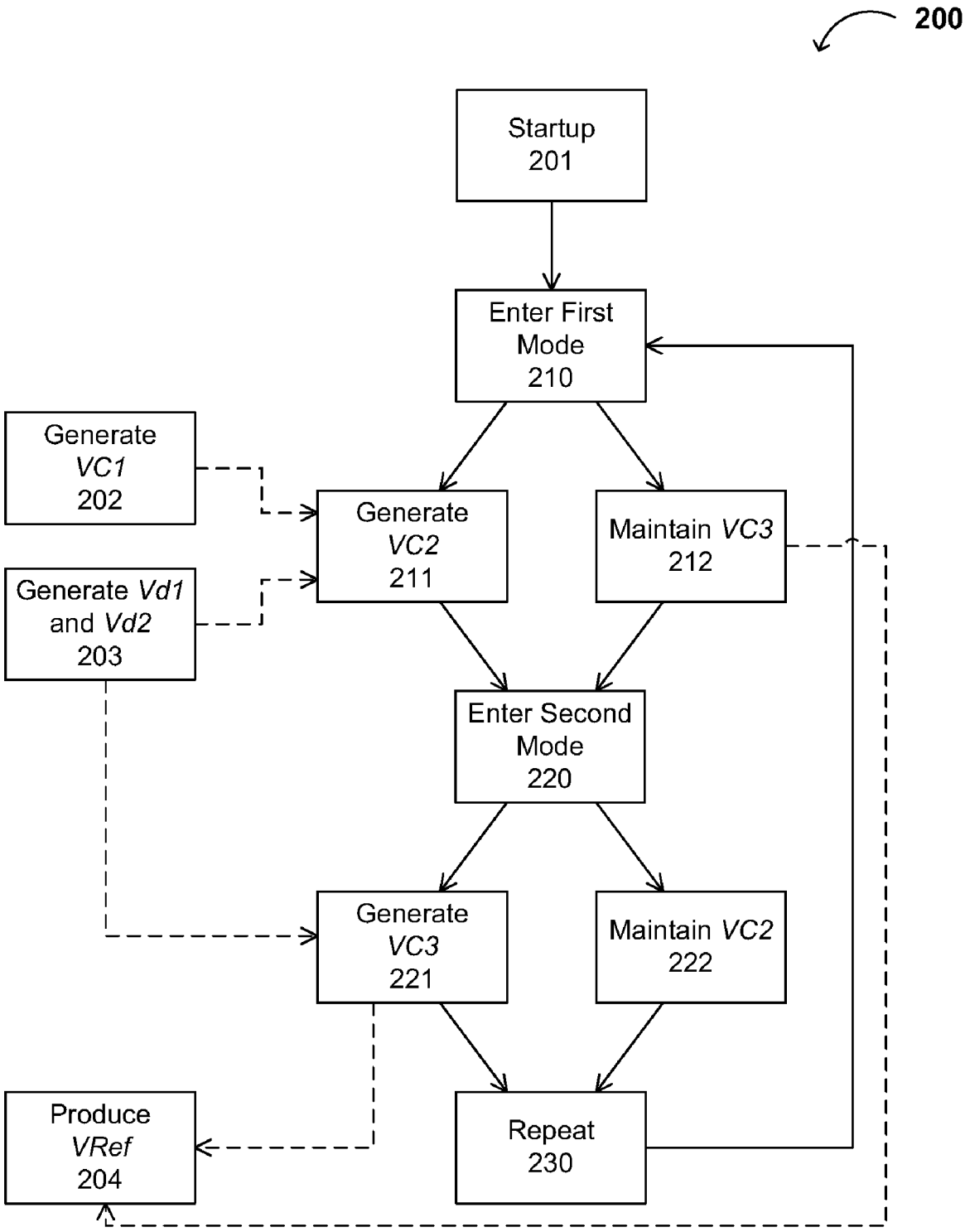
FIG. 2 is a flow-chart showing an exemplary method of generating a reference voltage.

FIG. 2 shows a flow chart explaining an exemplary method 200 for generating a reference voltage. First, at step 201 the reference voltage generator starts up at step 201. Startup 201 may include, for example, charging one or more capacitors to a threshold values and/or setting other initialization values prior to beginning normal operation.

At step 203, a first diode junction voltage (Vd1) is charged in response to a first bias current density, and a second diode junction voltage (Vd2) is generated in response to a second bias current density. The first bias current density may generally be higher than the second bias current density, such that a difference between Vd1 and Vd2 is sufficient to provide a PTAT component. Step 203 may provide Vd1, Vd2, or both during both modes of operation of the method, as described herein with respect to exemplary embodiments that operate according to this method.

At step 202, a first composite voltage (VC1) is generated such that VC1 comprises at least a fraction of the first and/or second diode junction voltage. One or more components of VC1 may be generated during the first mode and/or the second mode of operation.

After startup 201, at step 210, the method enters a first mode of operation. During the first mode of operation, at step 211 a second composite voltage (VC2) is generated such that VC2 comprises a difference between Vd2 and a sum of the VC1 and an offset voltage (Ve) of an amplifier. Also during the first mode, at step 212 the third composite voltage (VC3), which is generated in a preceding iteration of the second mode, is maintained.

At step 220, the second mode of operation begins. During the second mode of operation, VC2 is maintained at step 222. At step 221, VC3 is generated such that the third composite voltage is proportional to a difference between the first diode junction voltage and a sum of the Ve and VC2. Thus, as described with respect to FIG. 2, VC3 may comprise a CTAT component and a PTAT. As a result, VC3 is generally temperature-stable and also cancels out any offset voltage in an amplifier or other summation component used in generating output voltage. Furthermore, since VC3 is held constant during both phases, the output reference voltage VRef, proportional to VC3, may be continuously generated.

A Second Exemplary Circuit

Figure 3A:
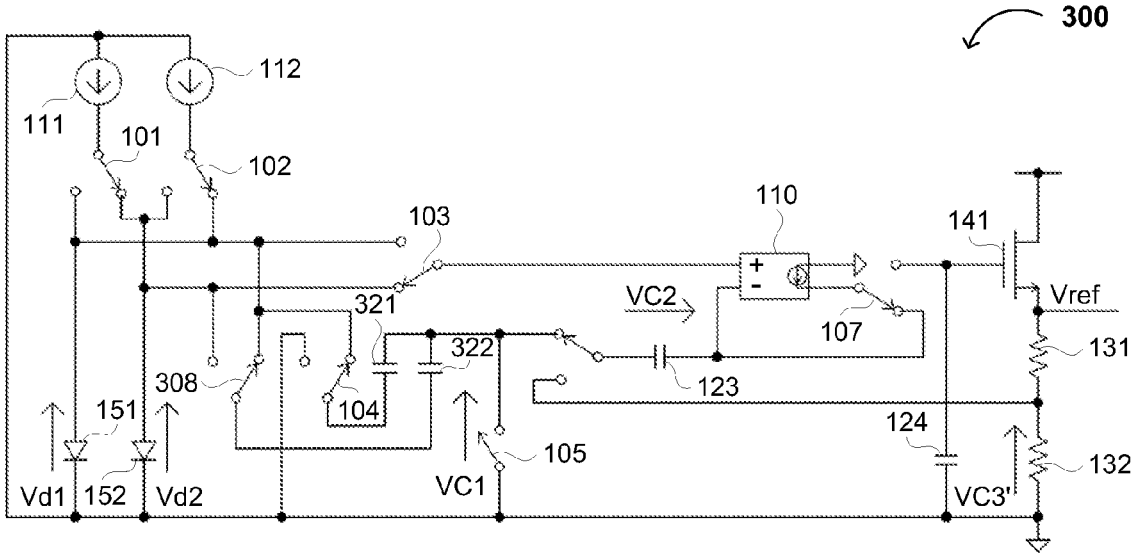
FIGS. 3A and 3B are diagrams of another exemplary embodiment of a circuit for generating a reference voltage, in two different modes of operation.
Figure 3B:
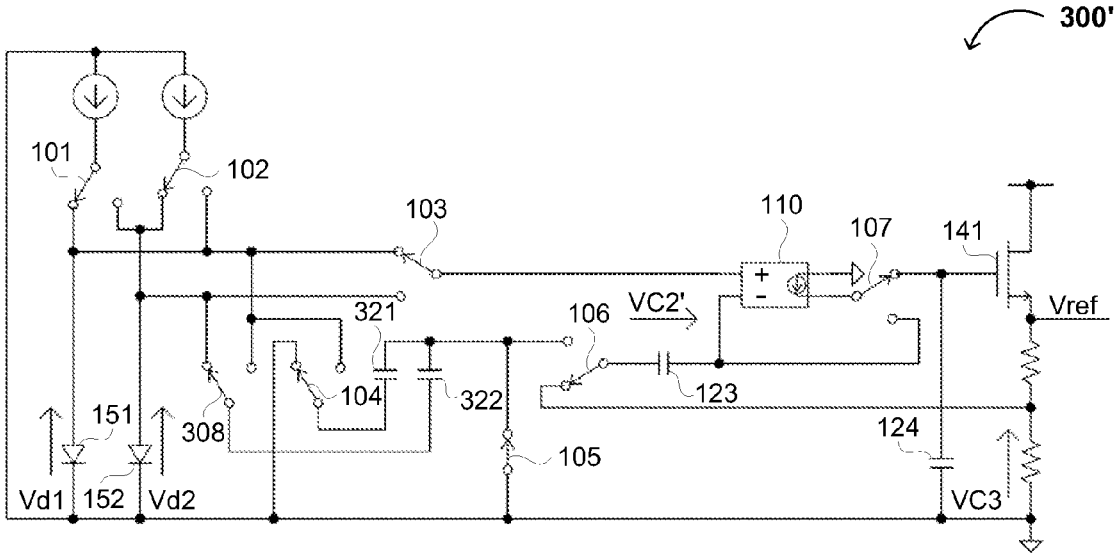

FIG. 3A shows a simplified exemplary circuit 300 in a first state or mode of operation. FIG. 3B shows the same circuit 300' in a second state or mode of operation. Circuit 300 shows a different exemplary first composite voltage generator from that shown in circuit 100. The new first composite voltage generator produces composite voltage VC1 using capacitors 321 (C1) and 322 (C2) and switch 308. Components with similar reference numerals are substantially the same as those shown in FIGS. 1A/B. The common terminal of changeover switch 308 is connected to the second terminal of capacitor 322, the first terminal is connected to the first terminal of diode 151 and the second terminal is connected to the first terminal of diode 152.

In the second mode of operation the capacitor 322 is coupled between the first terminal of diode 152 and the common ground and is thus charged to a voltage Vd2 with the second terminal being positive with respect to the first. During the second mode of operation capacitor 321 is discharged. In the first mode of operation the second terminal of capacitor 322 is connected to diode 151 and thus receives a voltage Vd1, while the first terminal and the second terminal of capacitor 321 are disconnected from the common ground, as in the first embodiment. Applying the rules of charge transfer and superposition it will be understood that the composite voltage VC1 of the first mode of operation under steady-state conditions is given by:

$$VC1 = (Vd1 - Vd2)\frac{C2}{C1 + C2} + Vd1\frac{C1}{C1 + C2} \quad \text{(EQ. 8)}$$

As a result, voltages VC3 and VC3' may be calculated according to the equation:

$$VC3' = VC3 = (Vd1 - Vd2)\left(1 + \frac{C2}{C1 + C2}\right) + Vd1\frac{C1}{C1 + C2} \quad \text{(EQ. 9)}$$

Thus, composite voltage VC3 may be substantially higher in circuit 300 than in circuit 100. As a result, the noise contribution of the transconductor 110 and/or other elements may be reduced. For example, with a diode area ratio of 8:1 (e.g., wherein diode 151 is a center element of a 3 by 3 array of substantially identical diodes and diode 152 comprises the eight surrounding elements) circuit 300 produces values of VC3 which would otherwise require a ratio of approximately 45:1. In another example, with a diode area ratio of 24:1 (e.g., wherein diode 151 is a center element of a 5 by 5 array of substantially identical diodes and diode 152 comprises the 24 surrounding elements), circuit 300 may produce values of VC3 which would otherwise require a ratio of approximately 270:1.

As with circuit 100, circuit 300 is configured such that the difference between the Vd1 and Vd2 components is substantially resistant to process variations between the current sources 111 and 112 used to bias one or more diodes. Thus, current sources 111 and 112 are not required to be well matched and the difference voltage Vd1−Vd2 will be substantially insensitive to low frequency noise components of these currents (e.g., where the frequency of the noise is low frequency meaning much lower than the frequency of iteration of the first and second modes or states).

Equations EQ. 4 and EQ. 9 may be combined to determine the relationship between capacitors 321 (C1) and 322 (C2) in order to obtain a temperature-stable voltage at VC3. Accordingly, capacitors 121 (C1) and 122 (C2) may be selected according to the following relationship:

$$C1 = 2C2\frac{Vd1 - Vd2}{Vbg - Vd1} \quad \text{(EQ. 10)}$$

Thus, the temperature-stable voltage may be calculated according to the equation:

$$VC3stab = \frac{2(Vd1 - Vd2)Vbg}{Vbg - 2Vd2 + Vd1} \quad \text{(EQ. 11)}$$

Figure 8:
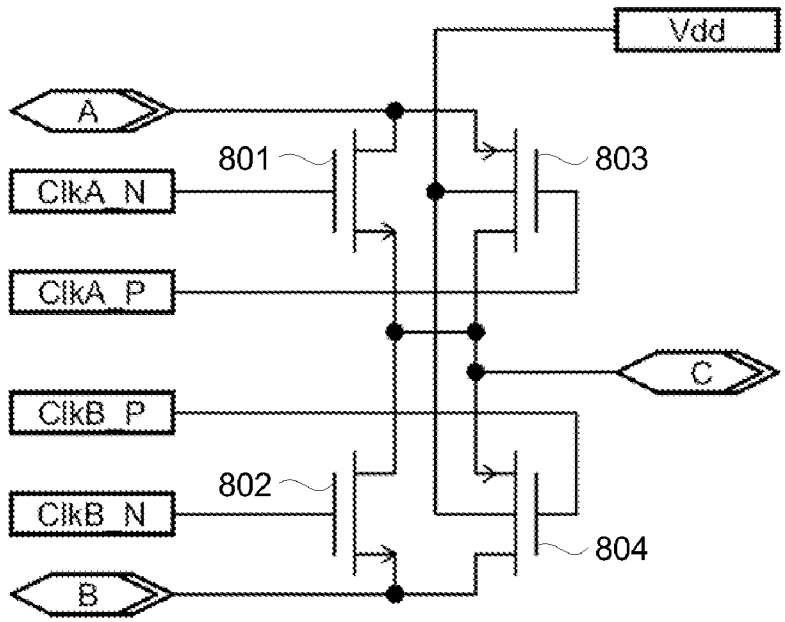
FIG. 8 is a circuit diagram of an exemplary implementation of a changeover switch as may be used by the present embodiments.

A person skilled in the art will be able to design and build a reference voltage generator according to the embodiments described herein. The changeover switches (e.g., changeover switches 101-104, 106, 107, etc.) may generally be configured as shown in FIG. 8 to respond to a clock signal (e.g., PMOS clock signal 701' or clock signal 702, and/or complementary NMOS clock signals 701 and 702') in order to repeatedly alternate between the first mode of operation and the second mode of operation. Thus, the first and second modes of operation may variously be called states, phases, etc. The clock signals may be adapted to switch NMOS and/or PMOS devices between conducting and non-conducting states, with non-conducting overlap. For simplicity the clock connections to these switches and/or transmission gates are not shown.

Simple switches may, for example, be implemented with NMOS and/or PMOS transistors. For example, switch 105 may be realized by an NMOS transistor (because a PMOS device would not conduct in this position). The switches 101 and 102 may implemented with paired PMOS devices, which may, however, be controlled by NMOS clock signals. If the clock signals overlap low, then the paths from the current sources are not interrupted during transitions between the phases. The capacitors may be implemented with MOS transistors. In particular, with some technologies, the relatively large integration capacitor, 104, may advantageously be an MOS device.

The bottom plates of the capacitors 321 (C1) and 322 (C2) may be respectively connected to the common terminals of the switches 104 and 308 so that parasitic capacitances to the underlying substrate do not change the capacitance ratio. The circuit may be auto-biased to isolate it from the supply line. Thus, a starting current supplied to capacitor 124 (C4) may be removed when the voltage on capacitor 124 reaches a threshold level.

A Third Exemplary Circuit

Figure 4A:
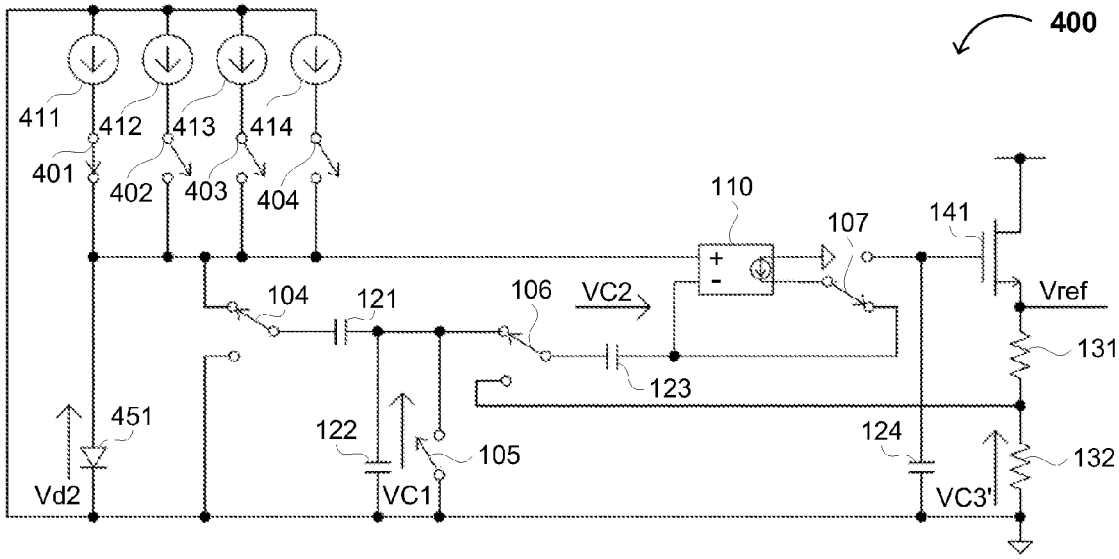
FIGS. 4A and 4B are diagrams of an exemplary embodiment of a circuit for generating a reference voltage, using a sequentially selected set of current sources to produce diode bias currents, in two different modes of operation.
Figure 4B:
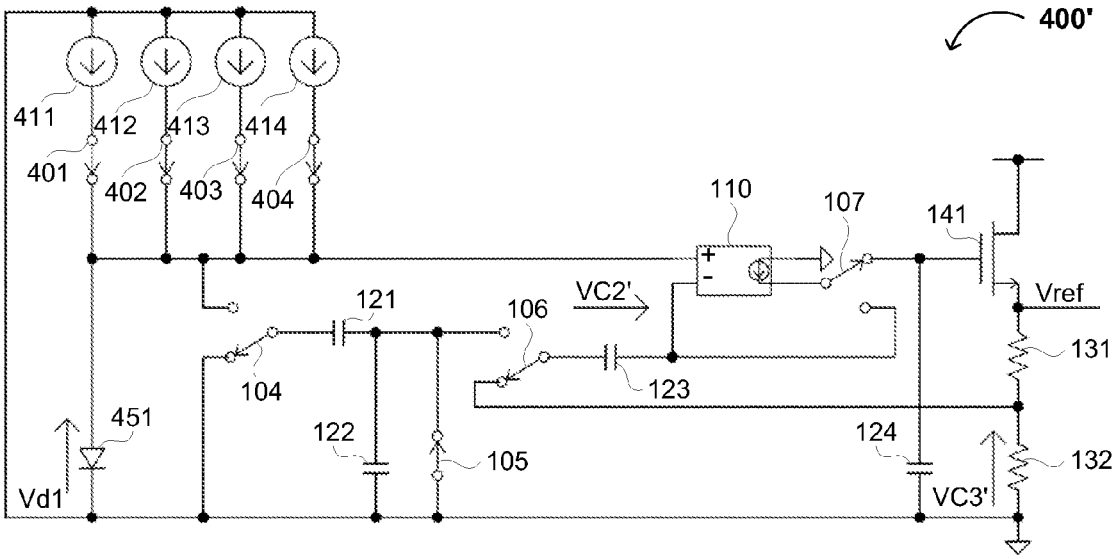

FIG. 4A shows a simplified exemplary circuit 400 in a first state or mode of operation. FIG. 4B shows the same circuit 400' in a second state or mode of operation. Circuit 400 shows a different exemplary diode junction voltage generator from that shown in circuit 100. In circuit 400, a single diode 451 may be alternately biased at lower and higher currents to provide the two different diode junction voltages charged at different current densities. Components with similar reference numerals are substantially the same as those shown in FIGS. 1A/B, and operate in a similar manner.

Diode 451 is biased at a current which is higher during the second mode of operation (to produce diode junction voltage Vd1) than during the first mode of operation (to produce diode junction voltage Vd2). In circuit 400, the bias currents are generated by a plurality of nominally equal current sources which are coupled in parallel during each interval of the second mode of operation and from which one is selected sequentially during successive intervals of the first mode of operation. Four such current sources are shown in FIGS. 4A/B but any number of current sources may be provided.

The sequential selection of current sources tends to make the average output voltage substantially insensitive to mismatch between the current sources. For example, an exemplary circuit may have N current sources, where N−1 of the sources generate a substantially similar current I and one current source is mismatched, generating a current I+δI where δI is relatively small compared to I. When the mismatched source is selected in the first mode of operation the PTAT component may be calculated according to the equation:

$$\begin{aligned} V &= V_T \ln\frac{NI+\delta I}{I+\delta I} \\ &= V_T\left(\ln N + \ln\left(1+\frac{\delta I}{NI}\right) - \ln\left(1+\frac{\delta I}{NI}\right)\right) \\ &\approx V_T \ln N - V_T\frac{\delta I}{I}\frac{N-1}{N} \end{aligned} \quad \text{(EQ. 12)}$$

where the approximation is:

$$\ln(1+x)\approx x, x<<1 \quad \text{(EQ. 13)}$$

During the other N−1 clock cycles the PTAT component may be calculated according to the equation:

$$\begin{aligned} V &= V_T \ln\frac{NI+\delta I}{I} \\ &= V_T\left(\ln N + \ln\left(1+\frac{\delta I}{NI}\right)\right) \\ &\approx V_T \ln N + V_T\frac{\delta I}{NI} \end{aligned} \quad \text{(EQ. 14)}$$

With the first order log approximation the average error can be shown to be zero. Using the second order log approximation $x-x^2/2$, the error may be calculated according to the equation:

$$\frac{V_T}{N}\frac{N-1}{2N}\left(\frac{\delta I}{I}\right)^2 \quad \text{(EQ. 15)}$$

Thus, a mismatch of 20% in one of four current sources may result in an average PTAT error of less than 100 μV. Furthermore, low frequency noise produced by the current sources may be attenuated in a similar manner to mismatch errors.

A Fourth Exemplary Circuit

Figure 5A:
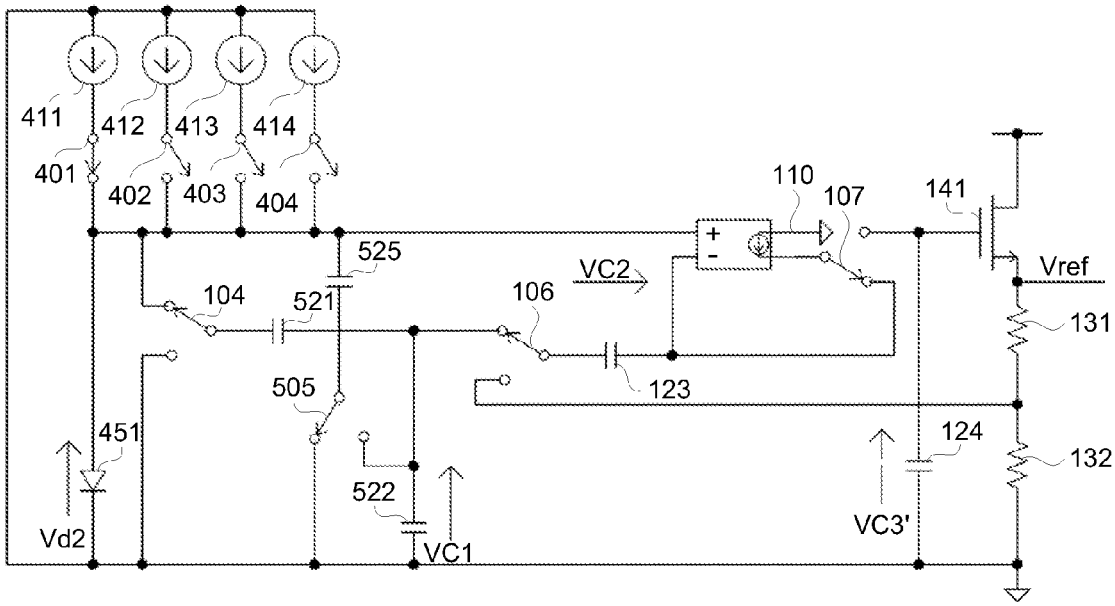
FIGS. 5A and 5B are diagrams of another exemplary embodiment of a circuit for generating a reference voltage, using a sequentially selected set of current sources to produce diode bias currents, in two different modes of operation.
Figure 5B:
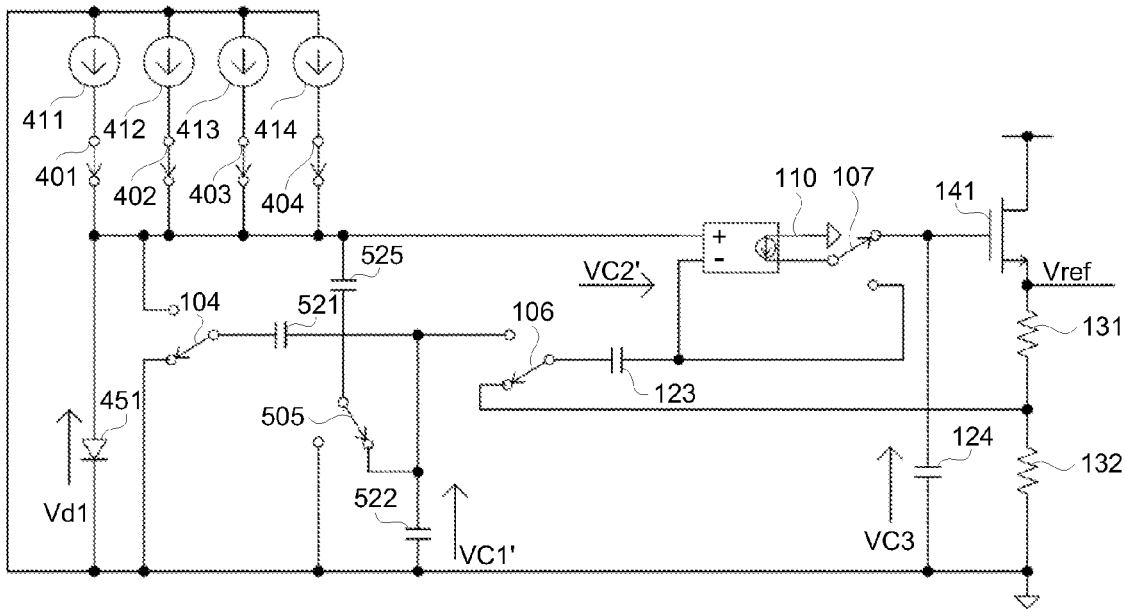
Figure 6A:
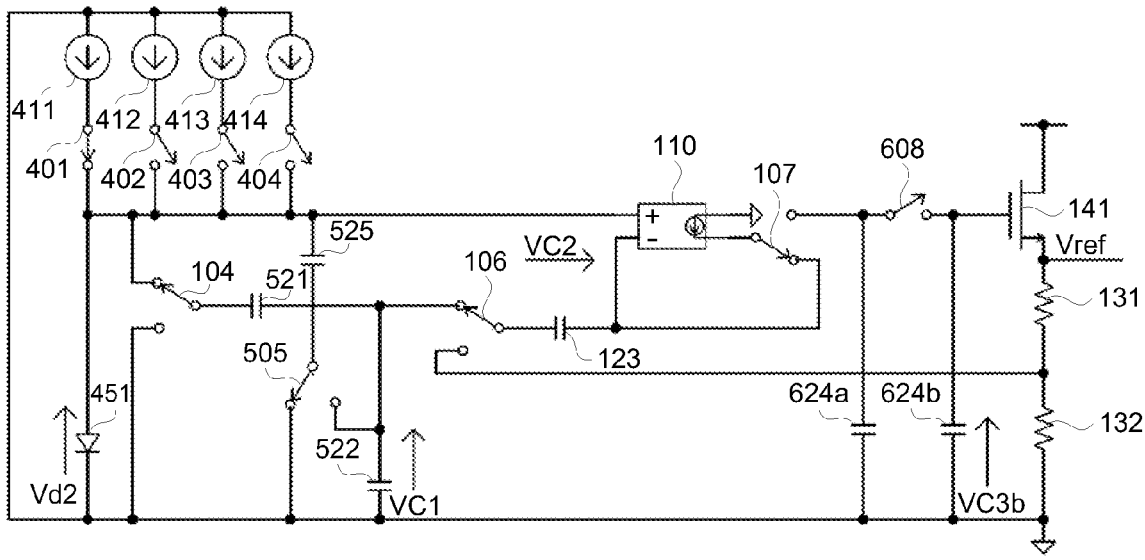
FIGS. 6A-6D are diagrams of another exemplary embodiment of a circuit for generating a reference voltage, in two different modes of operation and with compensation for current source mismatches.
Figure 6B:
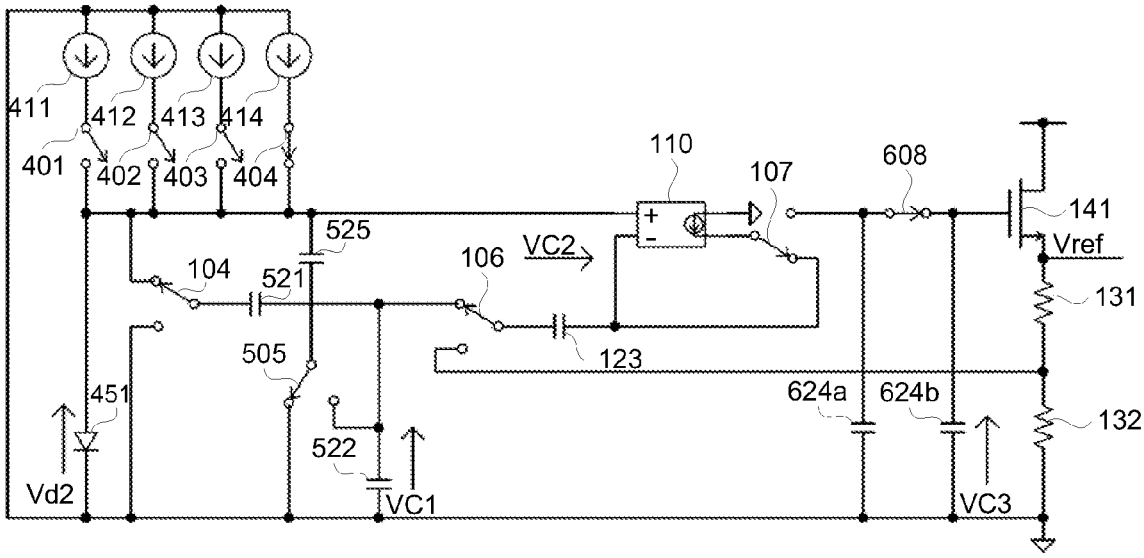
Figure 6C:
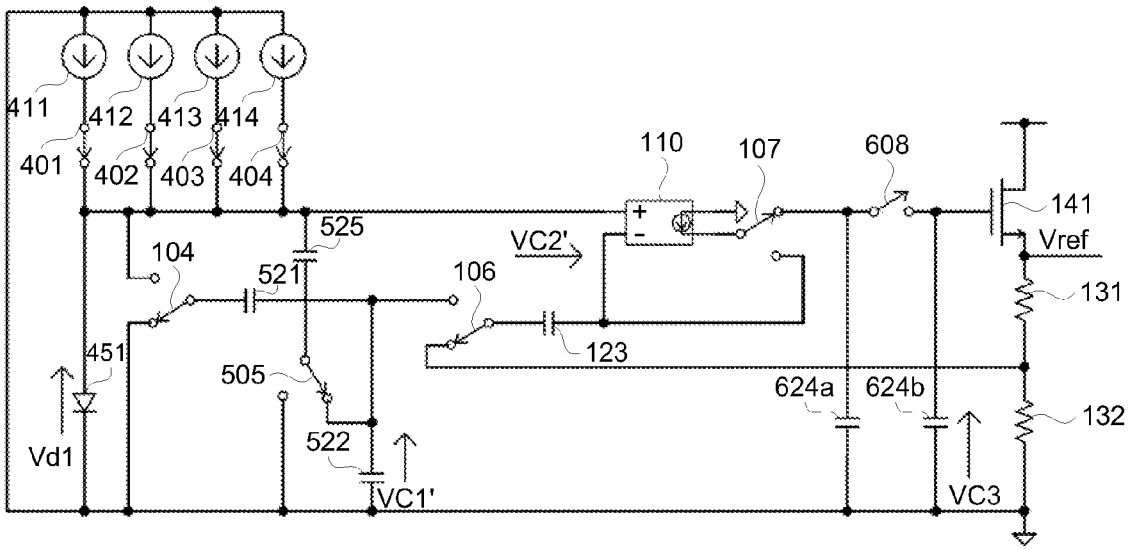
Figure 6D:
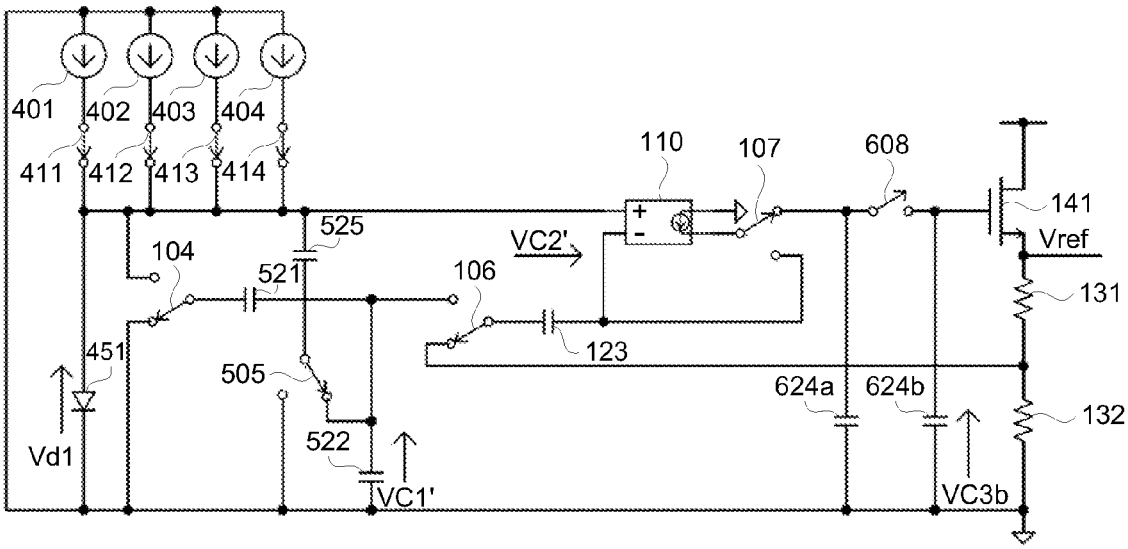

FIG. 5A shows a simplified exemplary circuit 500 in a first state or mode of operation. FIG. 5B shows the same circuit 500' in a second state or mode of operation. Circuit 500 includes the single-diode junction voltage generator as shown in FIGS. 4A/B but in which the first composite voltage generator uses a switched capacitor configuration to generate the composite voltage VC1, as in FIGS. 3A/B. Components with similar reference numerals are substantially the same as those shown in FIGS. 1A/B, FIGS. 3A/B, and/or FIGS. 4A/B, and operate in a similar manner.

Circuit 500 includes capacitor 525 (C5) and replaces the simple switch 105 with a changeover switch 505. Capacitor 525 has a first terminal connected to the diode 451 and a second terminal connected to the common terminal of changeover switch 505 which has a first terminal connected to the common ground and a second terminal connected to the first terminal of the changeover switch 106.

Thus, the PTAT component (e.g., Vd1−Vd2) may be added to the charge developed across capacitor 522 (C2) during the first mode of operation. The value of the capacitor 525 determines a time constant for the establishment of this component, but generally does not influence the steady-state voltages.

During the first mode of operation, the capacitor 525 is charged to the lower diode junction voltage Vd2. In the second mode of operation the voltage across the series combination of capacitors 521 and 522 may be reduced to substantially zero and the junction of the capacitors may be coupled via capacitor 525 to the higher diode junction voltage Vd1. There is no discharge path for the parallel combination of capacitors 521 and 522, so the voltage VC1' attains the steady-state value Vd1−Vd2.

Between the second mode of operation and the first, the voltage applied to the first terminal of capacitor 521 (C1) rises from 0 to Vd2. A fraction C1/(C1+C2) of this increase may be developed at the junction of C1 with C2 so the steady-state value of VC1 may be calculated according to the equation:

$$VC1 = (Vd1 - Vd2) + \frac{Vd2C1}{C1+C2} \quad \text{(EQ. 16)}$$

Thus, the full PTAT component is added to the CTAT component coupled to the capacitor 123 in the first mode of operation. The steady-state feedback voltage may therefore be calculated according to the equation:

$$VC3 = 2(Vd1 - Vd2) + \frac{Vd2C1}{C1+C2} \quad \text{(EQ. 17)}$$

Equations EQ. 4 and EQ. 17 may be combined to determine the relationship between capacitors 521 (C1) and 522 (C2) in order to obtain a temperature-stable voltage at VC3. Accordingly, capacitors 521 (C1) and 522 (C2) may be selected according to the following relationship:

$$C1 = 2C2\frac{Vd1 - Vd2}{Vbg - 2Vd1 - Vd2} \quad \text{(EQ. 18)}$$

Thus, the temperature-stable voltage may be calculated according to the equation:

$$VC3stab = \frac{2(Vd1 - Vd2)Vbg}{Vbg - Vd2} \quad \text{(EQ. 19)}$$

The time constant for the establishment of the additional PTAT component may be calculated according to the equation:

$$\tau = \frac{C5}{C1 + C2 + C5} \frac{1}{2\pi f CLOCK} \quad \text{(EQ. 20)}$$

A Fifth Exemplary Circuit

In diode junction voltage generators employing sequential selection of current sources, as shown in FIGS. 4 and 5, mismatch between the current sources which provide the diode bias may produce a tone and/or other disturbance in the reference voltage at the clock frequency divided by the number of current sources employed. In some cases this may be deleterious to the function of the reference generator.

FIGS. 6A-D show an exemplary embodiment which eliminates or substantially reduces such tones. This embodiment employs first and second integrating capacitors 624*a* and 624*b* coupled via a simple switch 608. The first integrating capacitor is connected between the second terminal of switch 107 and ground and is thereby coupled to the transconductor 110 output during the second mode of operation, substantially similar to the coupling of capacitor 124 in other embodiments. A second integrating capacitor 624*b* is coupled to the gate of the transistor 141 similarly to the coupling of capacitor 124 in the other embodiments.

Capacitor 624*a* is periodically coupled to the second integrating capacitor 624*b* via switch 608 during only one of the first mode of operation intervals in a sequence of N cycles, where N is the number of diode bias current sources. The charge accumulated on capacitor 624*a* during each sequence of N clock cycles is thus redistributed between capacitors 624*a* and 624*b* only once per sequence, and while capacitor 624*a* is disconnected from the transconductor. The voltage coupled to the gate of transistor 141 thereby results from the integration of the charge supplied by the transconductor during the N precedent clock cycles. Repetitive variations of the charge during the N cycles, such as would be produced by a mismatch between the diode bias current sources, therefore produce no tones. Preferably the total capacitance of capacitors 624*a* and 624*b* is distributed with 624*b* having the major component, thus reducing thermal noise generated by switch 107 in its closed state.

Other Variations

It will be understood that other means may be employed to implement certain aspects of the present embodiments, without changing their essence. In particular the voltage buffer shown employing an NMOS source follower 141 and resistive divider (resistors 131 and 132) in the exemplary embodiments may be replaced by any high input impedance, non-inverting, structure and other switched-capacitor structures may be employed to generate the aforesaid third voltage from two or more diode junction voltages.

Additionally a further switched capacitor low-pass filter may be included (e.g., between the second terminal of switch 107 and the inverting input of the amplifier 110). Thus, noise contributed by the amplifier (e.g., due to aliasing of high-frequency components at the transition from the second mode to the first) may be reduced.

The System and Network

The architectures, apparatuses, and/or systems generally comprise those that include a circuit embodying one or more of the inventive concepts disclosed herein. Embodiments may include one or more integrated circuit devices (e.g., general purpose microprocessors, system-on-chip [SOC] devices, application specific integrated circuits [ASICs], etc.) or other apparatuses that include the circuits and/or perform the operations described herein.

CONCLUSION/SUMMARY

Thus, embodiments of the present invention provide circuits, architectures, systems, and methods for generating temperature-stable reference voltages with offset compensation. Embodiments advantageously continuously produce temperature-stable reference voltages much smaller than the band-gap voltage, are substantially insensitive to any voltage offset in the associated summation circuit, and/or produce low noise without further filtering.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A circuit for generating a reference voltage, the circuit comprising:

an amplifier comprising an inverting input, a non-inverting input and a current output;

an integrator configured to integrate a charge from an input and to produce an output having a voltage proportional to the integrated charge;

a voltage buffer configured to produce one or more outputs in response to the integrated voltage;

a diode junction voltage generator configured to produce a first diode junction voltage in response to a first bias current density, and to produce a second diode junction voltage in response to a second bias current density, wherein the first bias current density is higher than the second bias current density;

a first composite voltage generator configured to generate a first composite voltage comprising at least a fraction of the first and/or second diode junction voltage;

a first capacitor having first terminal and a second terminal, the second terminal coupled to the amplifier inverting input; and a plurality of switches configured to alternate between a first mode of operation and a second mode of operation, wherein:

one or more of the plurality of switches are configured to, in the first mode of operation, couple the amplifier output terminal to the amplifier inverting input terminal, couple the second diode junction voltage to the amplifier non-inverting input terminal, and couple the first composite voltage to the first terminal of the first capacitor; and, one or more of the plurality of switches are configured to, in the second mode of operation, couple the first diode junction voltage to the amplifier non-inverting input, couple the amplifier output to the integrator input, and couple a first one of the voltage buffer outputs to the first terminal of the first capacitor.

2. The circuit of claim 1, configured such that, in the first mode of operation, the first capacitor is charged to a second composite voltage VC2, wherein VC2=Vd2−Ve−VC1, Vd2 is the second diode junction voltage, Ve is an offset voltage of the amplifier, and VC1 is the first composite voltage.

3. The circuit of claim 1, configured such that, after a plurality of iterations of the first mode of operation and the second mode of operation, VC3=Vd1−Vd2+VC1, wherein VC3 is the voltage of the first voltage buffer output, Vd1 is the first diode junction voltage, Vd2 is the second diode junction voltage, and VC1 is the first composite voltage.

4. The circuit of claim 1, configured such that the one or more voltage buffer outputs are substantially independent of temperature and/or an offset voltage of the amplifier during both the first and second modes of operation.

5. The circuit of claim 1, wherein the plurality of switches comprise transistor switches controlled by a first clock signal and a second clock signal, wherein the phase of the second clock signal is complementary to the phase of the first clock signal.

6. The circuit of claim 1, wherein the diode junction voltage generator comprises a first diode configured to produce the first diode junction voltage in response to a first current source and a second diode configured to produce the second diode junction voltage in response to a second current source, wherein the first diode junction voltage is substantially larger than the second diode junction voltage.

7. The circuit of claim 6, wherein the first current source and the second current source are substantially equal and the second diode has a larger area than the first diode.

8. The circuit of claim 6, wherein the area of the first diode is substantially equal to the area of the second diode, and the first current source provides a substantially higher current than the second current source.

9. The circuit of claim 1, wherein:

the diode junction voltage generator comprises a first diode configured to produce the first diode junction voltage, a second diode configured to produce the second diode junction voltage, and a current source; and one or more of the plurality of switches is configured to couple the current source to the second diode during the first mode of operation and to couple the current source to the first diode during the second mode of operation; and the area of the first diode is substantially smaller than the area of the second diode.

10. The circuit of claim 1, further comprising a plurality of current sources configured to provide substantially equal currents, and wherein the diode junction voltage generator comprises a first diode configured to produce the first diode junction voltage in response to a bias provided by the plurality of current sources and to produce the second diode junction voltage in response to a bias provided by one of the plurality of current sources.

11. The circuit of claim 10, wherein one or more of the plurality of switches is configured to couple an output of a single current source to the first diode in the first mode of operation and to couple the outputs of the plurality of current sources to the first diode in the second mode of operation.

12. The circuit of claim 11, wherein one or more of the plurality of switches is configured to sequentially select the single current source from the plurality of current sources in each iteration of the first mode of operation.

13. The circuit of claim 12, wherein the integrator comprises a second capacitor coupled between the integrator input and the common ground, and a third capacitor coupled between the integrator output and the common ground, and an integrator switch coupled between the integrator input and the integrator output, wherein the integrator switch is configured to close at every Nth iteration of the first mode of operation and where N corresponds to the number of the plurality of current sources.

14. The circuit of claim 1, wherein the integrator comprises a second capacitor having a first terminal coupled to the integrator input and the integrator output, and a second terminal coupled to the common ground.

15. The circuit of claim 1, wherein the first composite voltage comprises a fraction of the first diode junction voltage and/or a fraction of the second diode junction voltage.

16. The circuit of claim 1, wherein:

the first composite voltage generator comprises a second capacitor coupled between a generator input and a common terminal and a third capacitor coupled between the common terminal and the common ground;

at least one of the plurality of switches is configured to discharge the second capacitor and the third capacitor in the second mode of operation and, in the first mode of operation, couple the first diode junction voltage and/or the second diode junction voltage to the generator input; and the first composite voltage comprises a voltage across the third capacitor corresponding to a fraction of the first diode junction voltage and/or the second diode junction voltage.

17. The circuit of claim 1, wherein:

the first reference voltage generator comprises a second capacitor coupled between a first generator terminal and a common terminal, and a third capacitor coupled between the common terminal and a second generator terminal;

at least one of the plurality of switches is configured to:

in the second mode of operation, discharge the second capacitor, couple the second generator terminal to the second diode junction voltage and couple the common terminal to the common ground, and in the first mode of operation, couple the first and second generator terminals to the first diode junction; and such that the first composite voltage comprises a voltage across the third capacitor corresponding to a fraction of a difference between the first diode junction voltage and the second diode junction voltage and to a fraction of the first diode junction voltage.

18. The circuit of claim 1, wherein:

the first composite voltage generator comprises a second capacitor coupled between a generator input and a common terminal, and a third capacitor coupled between the common terminal and the common ground, and a fourth capacitor;

at least one of the plurality of switches is configured to:

in the second mode of operation, couple the generator input to the common ground and couple the fourth capacitor between first diode junction voltage and the common terminal, and in the first mode of operation, couple the first generator input to the first diode junction voltage and decouple the fourth capacitor from the common terminal, and couple the fourth capacitor between the second diode junction voltage and the common ground; and such that the first composite voltage corresponds to a fraction of a difference between the first diode junction voltage and the second diode junction voltage and to a fraction of the first diode junction voltage.

19. An integrated circuit device comprising the circuit of claim 1.

20. A method of generating a reference voltage, the method comprising:

generating a first diode junction voltage in response to a first bias current density, and a second diode junction voltage in response to a second bias current density, wherein the first bias current density is higher than the second bias current density;

generating a first composite voltage comprising at least a fraction of the first and/or second diode junction voltage;

in a first mode of operation, generating a second composite voltage such that the second composite voltage comprises a difference between the second diode junction voltage and a sum of the first composite voltage and an offset voltage of an amplifier, and maintaining a third composite voltage; and in a second mode of operation, maintaining the second composite voltage, and generating the third composite voltage such that the third composite voltage is proportional to a difference between the first diode junction voltage and a sum of the offset voltage and the second composite voltage.

21. The method of claim 20, further comprising repeatedly alternating between the first and second modes of operation.

22. The method of claim 21, further comprising generating the reference voltage in proportion to the third composite voltage during the first and second modes of operation.

23. A circuit for generating a reference voltage, the circuit comprising:

a diode junction voltage generator configured to generate a first diode junction voltage in response to a first bias current density, and a second diode junction voltage in response to a second bias current density, wherein the first bias current density is higher than the second bias current density;

a first composite voltage generator configured to generate a first composite voltage comprising at least a fraction of the first and/or second diode junction voltage;

a second composite voltage generator configured to generate a second composite voltage during a first mode of operation such that the second composite voltage comprises a difference between the second diode junction voltage and a sum of the first composite voltage and an offset voltage of an amplifier, and to maintain the second composite voltage during a second mode of operation;

a third composite voltage generator configured to generate the third composite voltage during the second mode of operation such that the third composite voltage is proportional to a difference between the first diode junction voltage and a sum of the offset voltage and the second composite voltage, and to maintain the third composite voltage during the first period of operation.

24. The circuit of claim 23, further comprising a plurality of switches configured to alternate repeatedly between the first and second modes of operation.

25. The circuit of claim 23, further comprise a voltage buffer configured to generate the reference voltage in proportion to third composite voltage during the first and second modes of operation.

* * * * *